US006487971B1

(12) United States Patent
Anderson

(10) Patent No.: US 6,487,971 B1
(45) Date of Patent: Dec. 3, 2002

(54) LIGHT INITIATED DETONATOR

(75) Inventor: Matthew E. Anderson, Ontario, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 04/769,760

(22) Filed: Oct. 12, 1968

(51) Int. Cl.[7] ..... F42C 19/00
(52) U.S. Cl. ..... 102/201
(58) Field of Search ..... 102/70, 70.2, 201

(56) References Cited

U.S. PATENT DOCUMENTS

| | | | | | |
|---|---|---|---|---|---|
| 3,177,651 | A | * | 4/1965 | Lawrence | 102/201 |
| 3,325,317 | A | * | 6/1967 | Voight, Jr. | 149/7 |
| 3,351,016 | A | * | 11/1967 | Simpson | 102/202.1 |
| 3,362,329 | A | * | 1/1968 | Epstein | 102/201 |
| 3,528,372 | A | * | 9/1970 | Lewis | 102/201 |
| 3,956,991 | A | * | 5/1976 | Means | 102/213 |

* cited by examiner

*Primary Examiner*—Harold J. Tudor
(74) *Attorney, Agent, or Firm*—David Kalmbaugh

(57) ABSTRACT

An explosive detonator capable of initiating fuze explosive trains remotely by radiant energy from a flash of light impinging upon the surface of explosive.

10 Claims, 1 Drawing Sheet

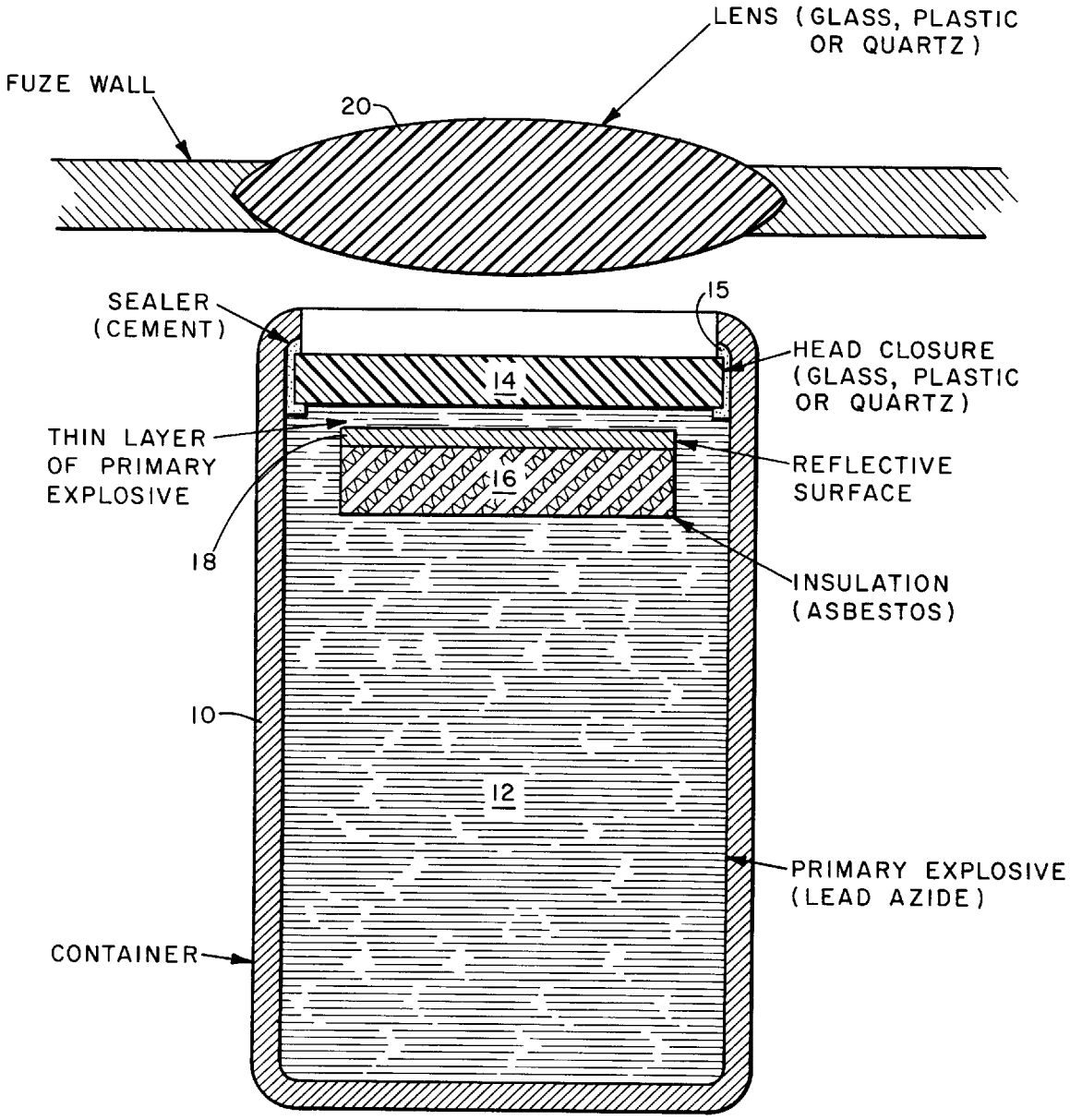
LENS (GLASS, PLASTIC OR QUARTZ)
FUZE WALL
20
SEALER (CEMENT)
15
HEAD CLOSURE (GLASS, PLASTIC OR QUARTZ)
14
THIN LAYER OF PRIMARY EXPLOSIVE
16
REFLECTIVE SURFACE
18
INSULATION (ASBESTOS)
10
12
PRIMARY EXPLOSIVE (LEAD AZIDE)
CONTAINER

LIGHT INITIATED DETONATOR

This invention is related to copending U.S. patent application Ser. No. 04/765,749, filed Oct. 3, 1968, for Optical, Semi-Active Bomblet Fuze, now U.S. Pat. No. 3,956,991.

The invention herein described may be manufactured and used by or for the Government of the United States of America for governmental purposes without the payment of any royalties thereon or therefor.

This fuze is designed to provide a proximity burst for bomblets. The proximity burst of bomblets is necessary to achieve increased weapon effectiveness, and the implementation of this need has existed as a significant problem. The optical semi-active bomblet fuze achieves a proximity burst of bomblets by sensing flashes of light emitted from preliminary target impacts by initiator charges. A light-initiated detonator is the key element in the development of that fuzing concept. The present invention provides a light-initiated detonator for use in such a fuze.

Other objects and many of the attendant advantages of this invention will become readily appreciated as the same becomes better understood by reference to the following detailed description when considered in connection with the accompanying drawings wherein:

The FIGURE of drawing shows a cross-sectional view of an embodiment of the present invention.

The detonator consists of a cup or container 10, of aluminum for example, which contains a primary explosive 12, such as lead azide which is pressed into the container; other explosives that may be used as the primary explosive are hereinafter discussed. A header or head closure 14 of glass, quartz or plastic for example, is used to seal container 10. A sealer cement 15 may be used to seal head closure 14 in place. Primary explosive 12 comes into immediate contact with head closure 14. A pad 16, of insulative material such as asbestos, is positioned near head closure 14 with a thin layer (approximately 0.050 inch, for example) of primary explosive 12 between the pad and the head closure. A reflective coating 18, of silver or aluminum for example, is provided on surface of pad 16 nearest head closure 14. Insulative pad 16 is of a smaller diameter than the inside of container 10, as shown in the drawing, thus providing continuity in the explosive from the thin layer between head closure 14 and reflective surface 18 to the main portion of the primary explosive.

A lens 20 or the like may be used to focus radiant energy through transparent head closure 14 onto the 4 surface of the thin layer of primary explosive 12. The insulative pad 16 with reflective surface 18 is used to concentrate the radiant energy which is focused on the surface of the detonator into the region of the thin layer of primary explosive to start the explosive reaction. Lens 20 and head closure 14 may be quartz if it is desired to transmit more energy in the ultraviolet region of the spectrum. Several explosives can be used as the primary explosive. Examples of such explosives, in order of preference, are as follows: lead azide—$Pb(N_3)_2$; silver acetylide (neutral precipitate)—$Ag_2C_2AgNO_3$; lead styphnate —$PbC_6H_3N_3O_9$; silver azide—$AgN_3$; mercury (II) azide—$Hg(N_3)_2$; mercury (I) acetylide—$Hg_2C_2$; silver fulminate—AgONC; mercury (II) fulminate $Hg(ONC)_2$; mercury (II) acetylide—$HgC_2$; and mix of 50% zirconium and 50% ammonium nitrate. These explosives are rapidly initiated by absorbing radiant energy within the spectrum of from 2000 to 20,000 angstroms. The remainder of explosive 12 filling container 10 is used to propagate the detonation on to an explosive lead which would be the next element in an explosive train. The insulation pad 16 is configured to allow the detonation to propagate from the thin layer of primary explosive adjacent head closure 14 to the pressed explosive in the remainder of the detonator container.

The detonator can be made less sensitive by eliminating or changing any of the insulating material, the reflective material, or the focusing lens.

What is claimed is:

1. A light-initiated fuze detonator, comprising:

(a) a container having an open end, (b) a primary explosive substantially filling said container, (c) a transparent closure sealing the open end of said container and in immediate contact with said explosive, (d) said primary explosive operable to be rapidly initiated by absorbing radiant energy within the spectrum of from 2000 to 20,000 angstroms, (e) an insulative pad imbedded in said explosive and positioned such that only a thin layer of said explosive is between said insulative pad and said transparent closure, said insulative pad being operable to concentrate radiant energy focused onto the detonator into the region of said thin layer.

2. A detonator as in claim 1 wherein said insulative pad has a reflective surface on the side thereof toward said end closure.

3. A detonator as in claim 1 wherein said thin layer of primary explosive between said end closure and said insulative pad is approximately 0.050 inch thick.

4. A detonator as in claim 1 wherein said insulative pad is configured to allow detonation to propagate from said thin layer of explosive to the remaining explosive in said container.

5. A detonator as in claim 1 wherein a lens means is mounted outside said container for focusing radiant energy onto said thin layer of explosive.

6. A detonator as in claim 1 wherein said primary explosive consists of lead styphnate.

7. A detonator as in claim 1 wherein said primary explosive consists of a neutral precipitate of silver acetylide.

8. A detonator as in claim 1 wherein said primary explosive consists of a mix of 50% zirconium and 50% ammonium nitrate.

9. A detonator as in claim 1 wherein said primary explosive consists of lead azide.

10. A detonator as in claim 1 wherein said primary explosive is selected from the group consisting of: silver azide, mercury (II) azide, mercury (I) acetylide, silver fulminate, mercury (II) fulminate, and mercury (II) acetylide.

* * * * *